US005702136A

United States Patent [19]

Funk et al.

[11] Patent Number: 5,702,136

[45] Date of Patent: Dec. 30, 1997

[54] MOTOR-VEHICLE DOOR LATCH WITH CHILD-SAFETY LOCKOUT

[75] Inventors: Bernhard Funk, Essen; Gerhard Menz, Heiligenhaus, both of Germany

[73] Assignee: Kiekert AG, Heiligenhaus, Germany

[21] Appl. No.: 627,184

[22] Filed: Apr. 3, 1996

[30] Foreign Application Priority Data

Apr. 4, 1995 [DE] Germany ..... 195 12 573.8

[51] Int. Cl.[6] ..... E05B 3/00

[52] U.S. Cl. ..... 292/336.3; 292/216; 292/DIG. 65

[58] Field of Search ..... 292/65 D, 336.3, 292/216, 23 D

[56] References Cited

U.S. PATENT DOCUMENTS

| | | | |
|---|---|---|---|
| 788,515 | 5/1905 | Carlson | 292/37 D |
| 2,903,840 | 9/1959 | Teupel et al. | 74/608 |
| 3,923,329 | 12/1975 | Torii et al. | 292/216 |
| 4,487,441 | 12/1984 | Miyamoto et al. | 292/336.3 |
| 4,900,074 | 2/1990 | Kleefeldt et al. | 292/336.3 |
| 5,046,769 | 9/1991 | Rimbey et al. | 292/216 |
| 5,052,731 | 10/1991 | Hayakawa et al. | 292/336.3 |
| 5,092,638 | 3/1992 | Mizuki . | |
| 5,125,701 | 6/1992 | Hayakawa et al. | 292/336.3 |

FOREIGN PATENT DOCUMENTS

| | | | |
|---|---|---|---|
| 388935 | 9/1990 | European Pat. Off. | 292/65 D |
| 47903 | 3/1979 | Japan | 292/65 D |
| 970538 | 9/1964 | United Kingdom | 292/65 D |

*Primary Examiner*—Rodney M. Lindsey
*Attorney, Agent, or Firm*—Herbert Dubno; Andrew Wilford

[57] ABSTRACT

A motor-vehicle door latch has a housing adapted to be mounted in a motor-vehicle door having an inner wall, an opening lever displaceable into an actuated position for unlatching the door, an inside door handle, and a child-safety button on the inner door wall displaceable between an actuated position and an unactuated position. A child-safety lever on the housing is displaceable between a child-safety on position and a child-safety off position and a child-safety actuating element connected to the button and to the lever is displaced by the button on displacement of the button between its actuated and unactuated positions between a pair of end positions corresponding to the on and off positions of the child-safety lever. An actuating assembly connected to the child-safety actuating element and connected between the inside door handle and the opening lever displaces the opening lever into the actuated position on operation of the inside door handle when the child-safety lever is in its off position and decouples the opening lever from the opening lever when the child-safety lever is in its on position.

6 Claims, 4 Drawing Sheets

MOTOR-VEHICLE DOOR LATCH WITH CHILD-SAFETY LOCKOUT

FIELD OF THE INVENTION

The present invention relates to a motor-vehicle door latch. More particularly this invention concerns such a door latch with a child-safety lockout.

BACKGROUND OF THE INVENTION

A standard motor-vehicle door latch normally mounted on a door movable relative to a door post comprises a plurality of mechanical assemblies, namely:

a latching assembly that normally includes a pivotal bolt-type fork, a latching pawl that can arrest the fork in a position engaging around a post-mounted bolt to latch the door, and an opening lever coupled to the latching pawl for operating same;

an actuating assembly typically formed by several levers, operable by inside and outside door handles, and coupling these handles to the opening lever of the latching assembly so that the latching assembly is operated via the actuating assembly by the inside and outside door handles to engage the pawl and unlatch the door a locking assembly connected between the actuating assembly and the outside handle and capable of uncoupling the outside handle from the actuating assembly or blocking movement of the outside handle in a locked position to prevent unlatching of the latch from outside in this locked position; and a child-safety assembly connected between the actuating assembly and the inside handle and capable of uncoupling the inside handle from the actuating assembly or blocking movement of the inside handle in a child-safety on position to prevent unlatching of the latch from inside in this on position. Thus the child-safety cutout or lockout can prevent the door from being opened from inside the vehicle.

Typically an actuating mechanism is provided that allows the child-safety assembly to be switched between its on and off positions. This mechanism normally includes an element that is mounted on a wall surface of the door that is not exposed when the door is closed and that can be moved to set the desired on or off position of the child-safety assembly. Thus the child-safety lockout can be set in its on or off position when the door is open only.

As described in U.S. Pat. No. 5,092,638 of Mizuki the child-safety actuating element is a knob that can be turned between a pair of positions corresponding to the on and off positions of the child-safety assembly. The knob is a snug fit in a complementary hole in the door wall so that foreign matter cannot readily get around it into the door, and the knob has an outside surface that is flush with the door surface to avoid anything getting caught on it.

In such a system if the fit of the knob is too tight, it cannot be turned. On the other hand if it is loose enough for easy operation, it leaves a path open for lubricant, water, or other foreign matter to get around the knob into the door. While a seal ring could be provided, this would add cost and could not be counted on to seal well over the long service life of a standard motor vehicle. Furthermore in this system the knob is in effect journaled in the door, so the door and latch must be made to very tight tolerances to insure that the knob fits properly with the latch mechanism as there is no possibility of adjustment after installation of the latch.

OBJECTS OF THE INVENTION

It is therefore an object of the present invention to provide an improved motor-vehicle door latch with a child-safety lockout.

Another object is the provision of such an improved motor-vehicle door latch with a child-safety lockout which overcomes the above-given disadvantages, that is which is of simple and inexpensive design, that is easy to use, and that seals tightly so no foreign matter can get into the latch via the child-safety mechanism.

SUMMARY OF THE INVENTION

A motor-vehicle door latch has according to the invention a housing adapted to be mounted in a motor-vehicle door having an inner wall, an opening lever displaceable into an actuated position for unlatching the door, an inside door handle, and a child-safety button on the inner door wall displaceable between an actuated position and an unactuated position. A child-safety lever on the housing is displaceable between an on position and an off position and a child-safety actuating element connected to the button and to the child-safety lever is displaced by the button on displacement of the button between its actuated and unactuated positions between a pair of end positions corresponding to the on and off positions of the child-safety lever. An actuating assembly connected to the child-safety actuating element and connected between the inside door handle and the opening lever displaces the opening lever into the actuated position on operation of the inside door handle when the child-safety lever is in its off position and decouples the opening lever from the opening lever when the child-safety lever is in its on position.

The child-safety lever system is monostable. This means that the child-safety lever is always biased in a direction tending to place it in one end position. Here a spring is provided that urges the child-safety lever into the off position to achieve this monostability. On the other and the button is stable in two positions and on each actuation moves the child-safety actuating element from whichever end position it is in to the other end position.

The button is provided according to the invention with means for retaining it in each of its positions when actuated while in the other of its positions. Thus when depressed, the button stays depressed until actuated again. Alternately the button can have means for returning it to one of its positions each time it is actuated. This is the type of actuation common on ball-point pens and push-button switches, that is each time the button is depressed it moves the child-safety actuating element to the other end position In accordance with the invention the button is positioned on the door in a location that is inaccessible when the door is closed and is dimensioned to be actuated by a finger. Thus when the door is opened the user can manually push in the button to change the setting of the child-safety lockout.

The system further has according to the invention a substantially closed housing set tightly in the wall of the door, containing the button, and having an end traversed by the child-safety actuating element, and a cuff sealed to the child-safety actuating element and to the closed housing. Thus the system can be mounted somewhat away from the latch itself with the actuating element making the connection. This installation can therefore be adjusted to fairly sloppy tolerances by lengthening or shortening the actuating element.

BRIEF DESCRIPTION OF THE DRAWING

The above and other objects, features, and advantages will become more readily apparent from the following description, reference being made to the accompanying drawing in which.

SPECIFIC DESCRIPTION

As seen in FIGS. 1 through 4 a motor-vehicle door latch according to this invention has a latching assembly comprised of an unillustrated fork and latch pawl as well as an opening lever 14 having a bent-over tab end 21 and pivoted on a housing 22 of the latch about an axis parallel to that of the unillustrated fork and pawl. Pivoting of this lever 14 unlocks a door carrying the housing 22.

Figure 1:
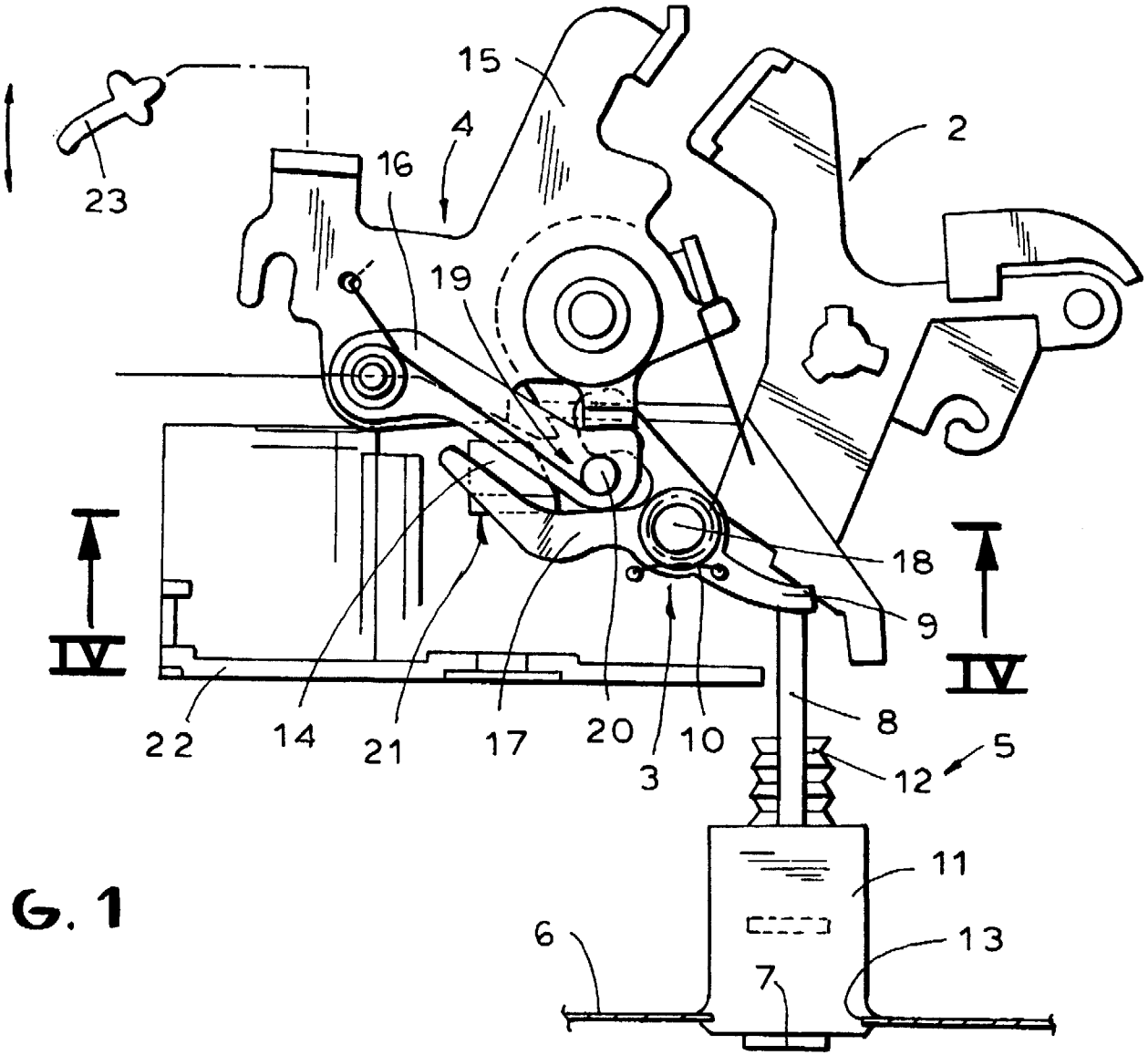
FIG. 1 is a partly schematic side view of the latch in the off position of the child-safety assembly.
Figure 2:
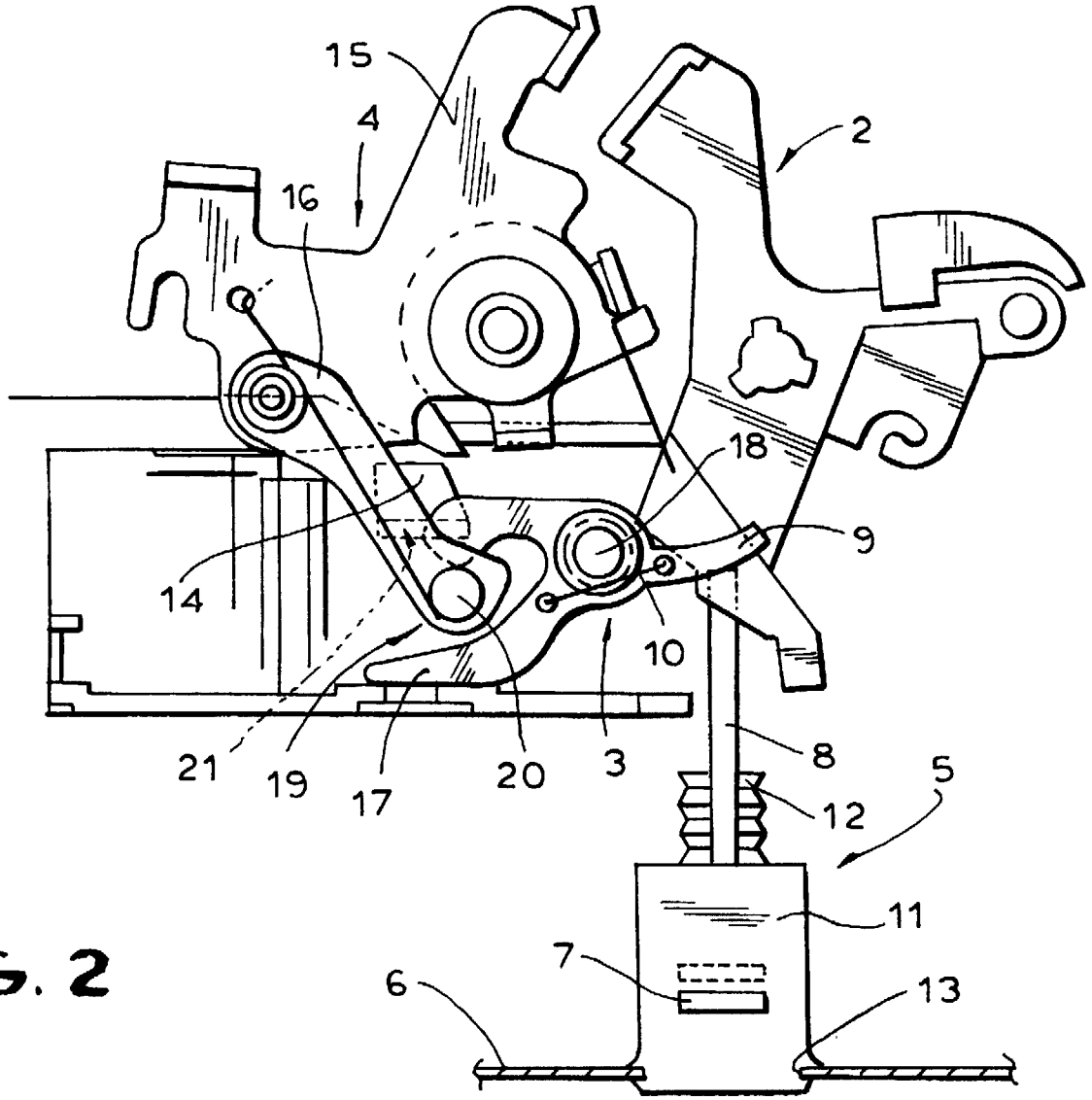
FIG. 2 is a view like FIG. 1 but with the child-safety assembly in the on position.
Figure 3:
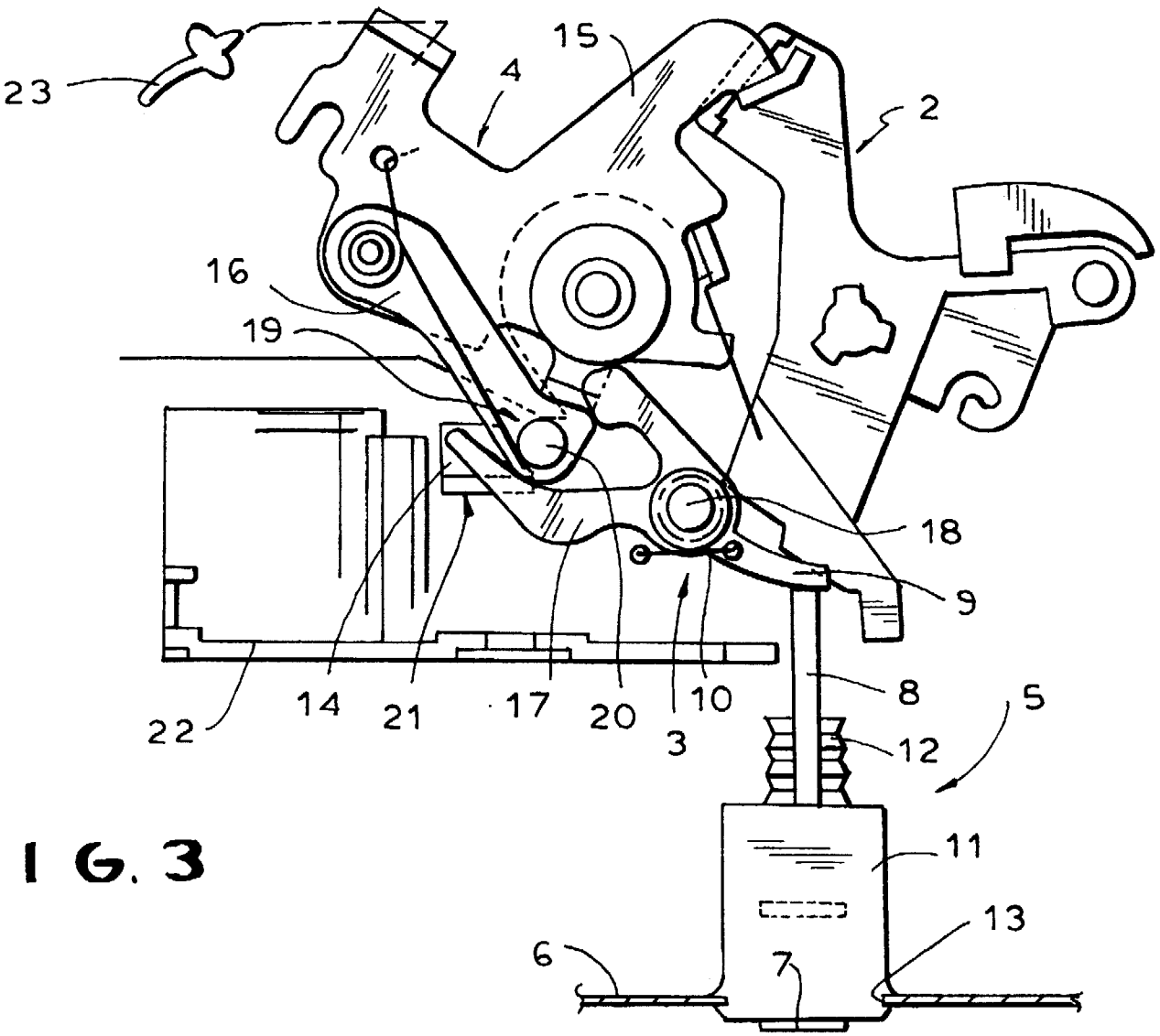
FIG. 3 is a view like FIG. 1 but with the child-safety assembly in the off position and the inside actuating element in the actuated position.
Figure 4:
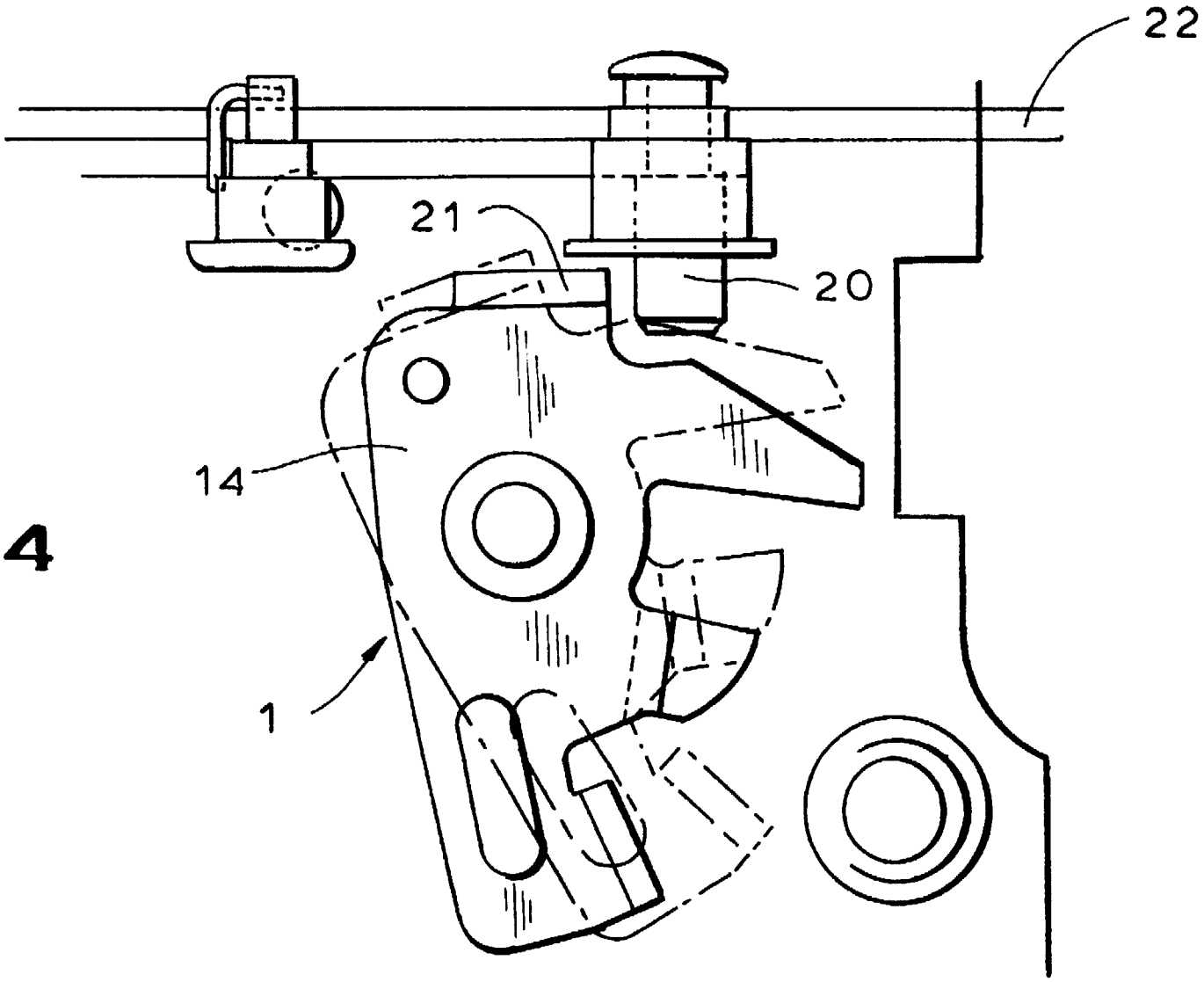
FIG. 4 is a section taken along line IV—IV of FIG. 1.

An actuating lever assembly 2 mounted in the housing 22 has an inside actuating-lever subassembly 4 comprised of a main inside actuating lever 15 and a secondary inside actuating lever 16 pivoted on the main lever 15. An inside door handle 23 can pivot the inside subassembly 4 between the normal or unactuated positions of FIGS. 1 and 2 and the actuated position of FIG. 3. A child-safety assembly 3 is mainly comprised by a child-safety lever 17 pivoted at 18 on the housing 22 and having a fork end 19. A pin 20 carried on the outer end of the secondary inside lever 16 is engaged in the fork 19 and is engageable with the bent-over end 21 of the opening lever 14 of the actuating assembly 2. In the position of FIGS. 1 and 3 with the child-safety system off, clockwise pivoting of the inside actuating assembly 4 by the handle 23 will press the pin 20 against the bent-over tab end 21 and displace the lever 14 into the actuated or releasing position, allowing the latched door to open. When in the on position of FIG. 2 the fork 19 pushes the pin 20 out of the path of the lever 14 by pivoting the lever 16 on the lever 15 so that clockwise pivoting of the assembly 4 will not be effective on the opening lever 14.

The child-safety assembly 3 is operated by a child-safety actuating assembly 5 comprising a housing 11 fixed tightly in an opening 13 in an inside or door-edge wall 6 and containing a depressible button 7 connected to a rod 8 that extends out of the housing 11 through a dust-tight flexible cuff 12 to an arm 9 of the lever 17 of the assembly 3. When in the outer position shown in solid lines in FIGS. 1 and 3 the child-safety cutout is off and a return spring 10 holds the lever 17 in a position allowing the pin 20 to couple the lever assembly 4 to the lever 14. When the button 7 is depressed as shown in FIG. 2 or in dashed lines in FIGS. 1 and 3, the rod 8 pushes the lever 17 into the child-safety on position, decoupling the assembly 4 from the lever 14.

The button 7 can constitute a single- or two-position actuator. In a two-position system when it is depressed to push in the rod 8 it stays depressed until it is pushed again, whereupon it pops out with the rod. This two-position actuation is convenient in that it provides a clear indication of the position the system is set in, but has the disadvantage that in the child-safety on position the button 7 is recessed and leaves a hole that can catch dirt. In a one-position system, with each depression of the button 7 the rod 8 moves from whichever position it is in to the other position, with the button 7 always returning to the outer position, like the button on a click-type ball-point pen. Obviously this system has the disadvantage that it gives no immediate visual indication of what position it is in, but has the advantage that it is always generally flush so no foreign matter is trapped.

In the illustrated embodiment the rod 8 of the assembly 5 is in constant engagement with the arm 9 of the lever 17. Alternatively the connection can be set up like a crank. When the element 8 is fixed to the arm 9 of such a crank the spring 10 can also be set up for two-position operation.

We claim:

1. A motor-vehicle door latch comprising;

a latch housing adapted to be mounted in a motor-vehicle door having an inner wall;

means including an opening lever displaceable into an actuated position for unlatching the door;

an inside door handle;

a child-safety housing mountable on the inner door wall and provided with a button linearly displaceable in the child-safety housing between an actuated position and an unactuated position;

a child-safety lever on the latch housing displaceable between a child-safety on position and a child-safety off position;

means connected to the child-safety lever for biasing it continuously into one of its positions;

a child-safety actuating element extending out of the child-safety housing, connected to the button and engaging the child-safety lever, and displaceable by the button on displacement of the button between its actuated and unactuated positions between a pair of end positions corresponding to the on and off positions of the child-safety lever; and actuating means connected to the child-safety actuating element and connected between the inside door handle and the opening lever for displacing the opening lever into the actuated position on operation of the inside door handle when the child-safety lever is in its off position and for decoupling the inside handle from the opening lever when the child-safety lever is in its on position.

2. The motor-vehicle door latch defined in claim 1 wherein the biasing means included a spring urging the child-safety lever into the off position.

3. The motor-vehicle door latch defined in claim 1 wherein the button is linearly movable in the child-safety housing transversely of the door between its actuated and unactuated positions.

4. The motor-vehicle door latch defined in claim 1 wherein the button is provided with means for returning it to one of its positions each time it is actuated.

5. The motor-vehicle door latch defined in claim 1 wherein the child-safety housing can be positioned on the door in a location that is inaccessible when the door is closed and is dimensioned to be actuated by a finger.

6. The motor-vehicle door latch defined in claim 1 wherein the child-safety housing is substantially closed, can be set tightly in the wall of the door, contains the button, has an end traversed by the child-safety actuating element, and is provided with a cuff sealed to the child-safety actuating element.

* * * * *